United States Patent [19]

Yamasaki et al.

[11] 4,291,620

[45] Sep. 29, 1981

[54] ERROR DETECTION IN A DIGITAL PRINTER EMPLOYING TYPE WHEELS

[75] Inventors: Hitoshi Yamasaki, Nara; Yasutaka Iwawaki, Kashihara, both of Japan

[73] Assignee: Sharp Kabushiki Kaisha, Osaka, Japan

[21] Appl. No.: 78,727

[22] Filed: Sep. 25, 1979

[30] Foreign Application Priority Data

Sep. 27, 1978 [JP] Japan ..... 53-119810

[51] Int. Cl.[3] ..... B41J 1/44

[52] U.S. Cl. ..... 101/99; 101/110; 400/74

[58] Field of Search ..... 101/93, 22, 95, 96, 101/99, 110; 400/144.2, 74, 144.5, 154.5, 162.3, 163; 340/146.1 R, 146.1 A, 146.1 AV

[56] References Cited

U.S. PATENT DOCUMENTS 3,884,144 5/1975 Shimodaira ..... 101/99

4,033,256 7/1977 Hanaoka ..... 101/99

4,170,937 10/1979 Nakagaki et al. ..... 101/99

4,175,488 11/1979 Minowa ..... 101/99

*Primary Examiner*—Edward M. Coven

*Attorney, Agent, or Firm*—Birch, Stewart, Kolasch and Birch

[57] ABSTRACT

A digital printer of the print wheel controlling type comprising a timing signal generator for developing type selection controlling signals ($\alpha$) for selecting a desired type mounted on the print wheel, and a wheel round detection signal ($\beta$) for indicating a complete one round of the print wheel. A print control circuit is provided for detecting whether the wheel round detection signal ($\beta$) is developed next after the development of the type selection controlling signals ($\alpha$) by a predetermined number. If the wheel round detection signal ($\beta$) is not developed at a preselected timing, the print control circuit learns an erroneous printing operation, and functions to conduct a corrected printing operation.

7 Claims, 7 Drawing Figures

ERROR DETECTION IN A DIGITAL PRINTER EMPLOYING TYPE WHEELS

BACKGROUND AND SUMMARY OF THE INVENTION

The present invention relates to a print control system for a printer including a plurality of print wheels on which a plurality of types are mounted.

A printer of the type wheel controlling type is well known in the art, wherein type selection controlling signals ($\alpha$) and wheel round detection signals ($\beta$) are developed in response to the rotation of a wheel shaft on which a plurality of print wheels are mounted. The type selection controlling signals ($\alpha$) are developed with a predetermined interval corresponding to a space provided between two adjacent types carried on the print wheel. When a desired type appears at a predetermined position, the rotation of the print wheel is precluded through the use of a locking mechanism. Operation of the locking mechanism is controlled by the type selection controlling signals ($\alpha$). The wheel round detection signals ($\beta$) are developed upon every complete one round of the wheel shaft for determining the initial condition of the print wheels.

An example of the above-mentioned printer of the type wheel controlling type is "DIGITAL PRINTER, MODEL-355" manufactured by SHARP KABUSHIKI KAISHA.

In such a printer of the type wheel controlling type, the type selection controlling signals ($\alpha$) are very important for controlling purposes. If the type selection controlling signals ($\alpha$) are erroneously counted due to some noise, an accurate printing cannot be expected.

Accordingly, an object of the present invention is to provide a print control system for ensuring an accurate printing operation in a printer which includes a plurality of print wheels.

Another object of the present invention is to provide an error condition detection system in a printer which includes a plurality of print wheels on which a plurality of types are mounted.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a determination system is provided for determining whether the type selection controlling signals ($\alpha$) are accurately counted. If an erroneous counting operation is revealed, a clear signal is developed to again conduct a corrected printing.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
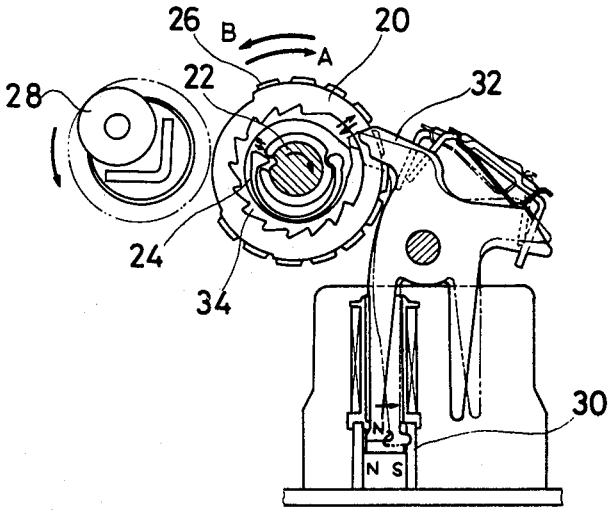
FIG. 1 PRIOR ART
FIG. 1 is a sectional view of an essential part of a printer of the print wheel controlling type.

Referring now in detail to the drawings, and to facilitate a more complete understanding of the present invention, a general construction of a printer of the print wheel controlling type will be first described with reference to FIGS. 1 and 2.

The printer of the print wheel controlling type mainly comprises a plurality of print wheels 20 mounted on a wheel shaft 22 with the intervention of a spring means 24. The print wheels 20 are provided by a desired digit number, and each print wheel 20 carries a plurality of types 26 mounted thereon. When a print start command is developed, a motor (not shown) is energized to rotate the wheel shaft 22 in the direction shown by an arrow "A." Accordingly, the plurality of the print wheels 20 are rotated in the direction of the arrow "A" in unison with the rotation of the wheel shaft 22.

When a desired type appears at a predetermined position confronting a print depression roller 28, an electromagnet mechanism 30 is energized to lock the print wheel 20 through the use of a locking click 32. The locking click 32 catches a ratchet wheel 34 which is connected to the print wheel 20. Once the ratchet wheel 34 is caught by the locking click 32, the print wheel 20 does not rotate even though the wheel shaft 22 continues rotation. In this way, desired types are placed at predetermined positions confronting the print depression roller 28 in a digit by digit fashion. A print receiving paper and an ink ribbon are disposed between the print wheels 20 and the print depression roller 28, thereby providing the print corresponding to the selected types on the print receiving paper.

After completion of the printing operation, the electro-magnet mechanism 30 is deenergized to release the ratchet wheel 34 from the locking click 32. Thereafter, the wheel shaft 22 is rotated in a direction shown by an arrow "B" due to the recoil strength of the spring means 24. At this moment, the print wheels 20 are also rotated in the direction shown by the arrow "B," and then the print wheels 20 are held stationary at their initial positions suited for the following printing operation. An indent is formed on the wheel shaft 22 so that the print wheel 20 is reversely rotated by the angle identical with the angle of the rotation which is performed during the type selection operation.

Figure 2:
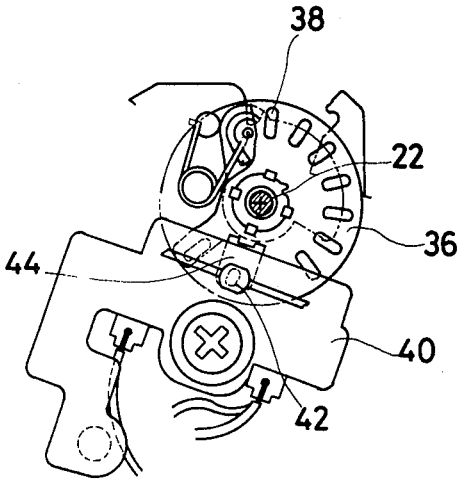
FIG. 2 PRIOR ART
FIG. 2 is a sectional view of a control signal developing system included in the printer of FIG. 1.

A slit plate 36 is mounted on the wheel shaft 22, as shown in FIG. 2, in such a manner that the slit plate 36 rotates in unison with the rotation of the wheel shaft 22. A plurality of slits 38 are formed in the slit plate 36 for detection purposes. The slits 38 are spaced apart from each other by a distance corresponding to the pitch of the types 26 mounted on the print wheel 20.

A slit detection optical system 40, which comprises a light emitting element 42 and a light responsive element, is associated with the slit plate 36 for developing detection signals in response to rotation of the slit plate 36. More specifically, the slit detection optical system 40 develops type selection controlling signals ($\alpha$) when the slits 38 appear at a position corresponding to the light path from the light emitting element 42 to the light responsive element. The thus developed type selection controlling signals ($\alpha$) are used to control the electromagnet mechanism 30 for selecting a desired type 26 carried on the print wheel 20.

A relatively large slit 44 is formed in the slit plate 36 for developing a detection signal upon every complete one round of the wheel shaft 22. The thus developed detection signal is referred to as a wheel round detection signal ($\beta$), and used for placing the print wheels 20 in the initial standby condition suited for the next printing operation.

Figures 3, 4, 5:
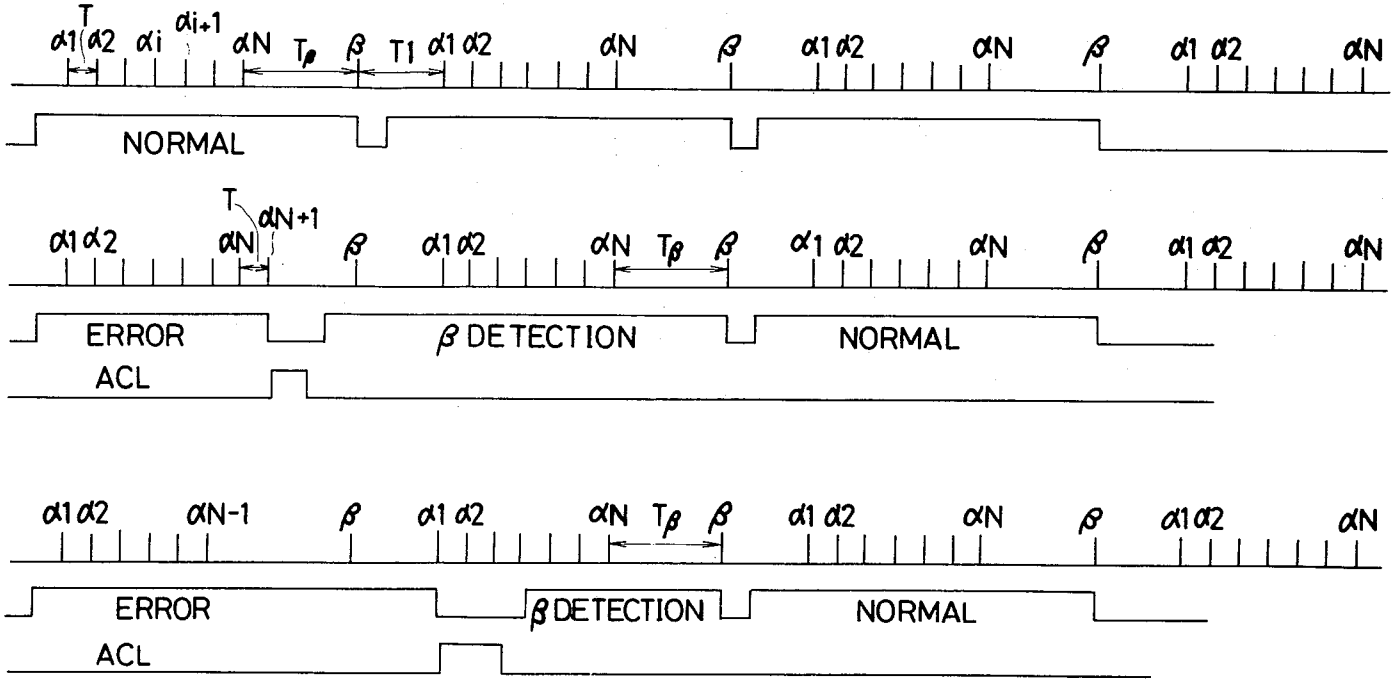
FIG. 3 PRIOR ART
FIG. 3 is a time chart for explaining operation of the printer of FIG. 1.
FIGS. 4 and 5 are time charts for explaining operation of an embodiment of a print control system of the present invention.

FIG. 3 shows the above-mentioned type selection controlling signals ($\alpha$) and the wheel round detection signal ($\beta$).

The type selection controlling signals ($\alpha$) are developed with the time interval T. The first type selection controlling signal $\alpha_1$ is developed at a timing suited for selecting the first type 26 carried on the print wheel 20. The last type selection controlling signal $\alpha_N$ is developed at a timing suited for selecting the N-th or the last type 26 carried on the print wheel 20. The wheel round detection signal $\beta$ is developed after the last type selection controlling signal $\alpha_N$ with a time interval $T_\beta$, thereby completing one cycle of the printing operation. The first type selection controlling signal $\alpha_1$ of the next cycle is developed after the wheel round detection signal $\beta$ with a time interval $T_1$. The actual printing is conducted at the time interval $T_\beta$ through the use of the print depression roller 28.

An example of the above-mentioned printer is commercially available as "DIGITAL PRINTER, MODEL-355" manufactured by SHARP KABUSHIKI KAISHA.

In the above discussed printer, the type selection controlling signals ($\alpha$) are very important for conducting the printing operation. However, there is a possibility that the type selection controlling signals ($\alpha$) are erroneously counted due to some noise. This will preclude an accurate, clean printing.

FIG. 4 shows a condition where the type selection controlling signals ($\alpha$) are erroneously developed more than the predetermined value N, and FIG. 5 shows a condition where the type selection controlling signals ($\alpha$) are erroneously developed less than the predetermined value N.

The print control system of the present invention mainly comprises a detection system for determining whether the wheel round detection signal $\beta$ is developed after the N-th type selection controlling signal $\alpha_N$. If the wheel round detection signal $\beta$ is not developed after the type selection controlling signal $\alpha_N$, the print control system functions to search the following wheel round detection signal $\beta$, thereby performing the corrected printing operation upon detecting the following wheel round detection signal $\beta$.

The determination whether the wheel round detection signal $\beta$ is developed after the N-th type selection controlling signal $\alpha_N$ is based on the following analysis. That is, the wheel round detection signal $\beta$ must satisfy the following relationship.

$T_\beta > T_1$ and $T_\beta > T$ where:

$T_\beta$ is the time interval from the occurrence of the N-th type selection controlling signal $\alpha_N$ to the occurrence of the wheel round detection signal B;

$T_1$ is the time interval from the occurrence of the wheel round detection signal $\beta$ to the occurrence of the following first type selection controlling signal $\alpha_1$; and T is the time interval provided between the two adjacent type selection controlling signals $\alpha$.

In the case where one additional type selection controlling signal ($\alpha$) is erroneously developed as shown in FIG. 4, the time interval from the N-th type selection controlling signal $\alpha_N$ to the next occurring signal ($\alpha_{N+1}$) is T. This time interval does not satisfy the above discussed relationship $T_\beta > T_1$, and $T_\beta > T$. That is, the wheel round detection signal $\beta$ is not developed after the N-th type selection controlling signal $\alpha_N$.

In the case where the type selection controlling signals ($\alpha$) are developed less than the predetermined value N by one count as shown in FIG. 5, the count system erroneously count the wheel round detection signal $\beta$ as the N-th type selection controlling signal $\alpha_N$. Therefore, the time interval from the N-th type selection controlling signal ($\beta$) to the next occurring signal ($\alpha_1$) is $T_1$. This time interval does not satisfy the above discussed relationship $T_\beta > T_1$, and $T_\beta > T$.

Figure 6:
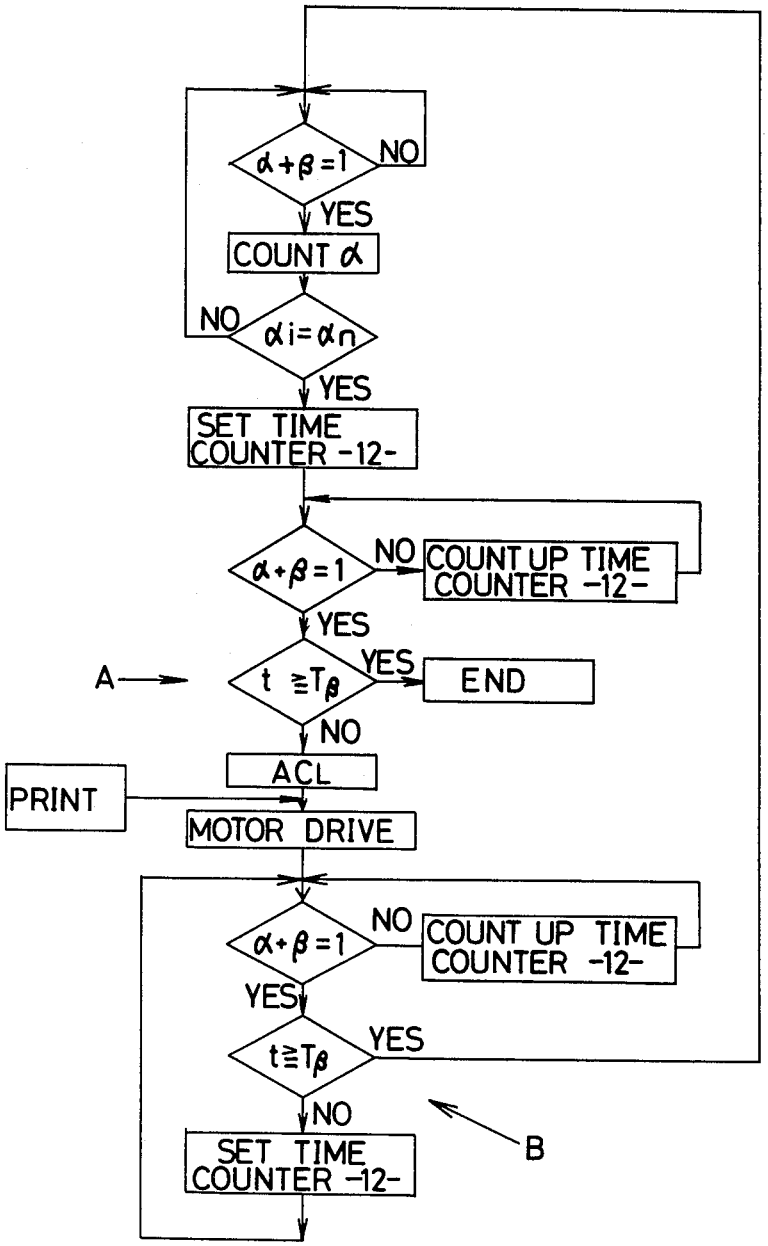
FIG. 6 is a flow chart for explaining operation of the embodiment of the print control system of the present invention.

FIG. 6 shows the mainflow of an embodiment of the print control system of the present invention.

A judgement "A" determines whether the wheel round detection signal $\beta$ appears after the N-th type selection controlling signal $\alpha_N$. If the actual wheel round detection signal $\beta$ is not developed after the N-th type selection controlling signal $\alpha_N$, the operation is advanced in the "NO" flow. A judgement "B" searches the following wheel round detection signal $\beta$. When the following wheel round detection singal $\beta$ is detected, the operation is returned to the initial condition for conducting the corrected printing operation.

Figure 7:
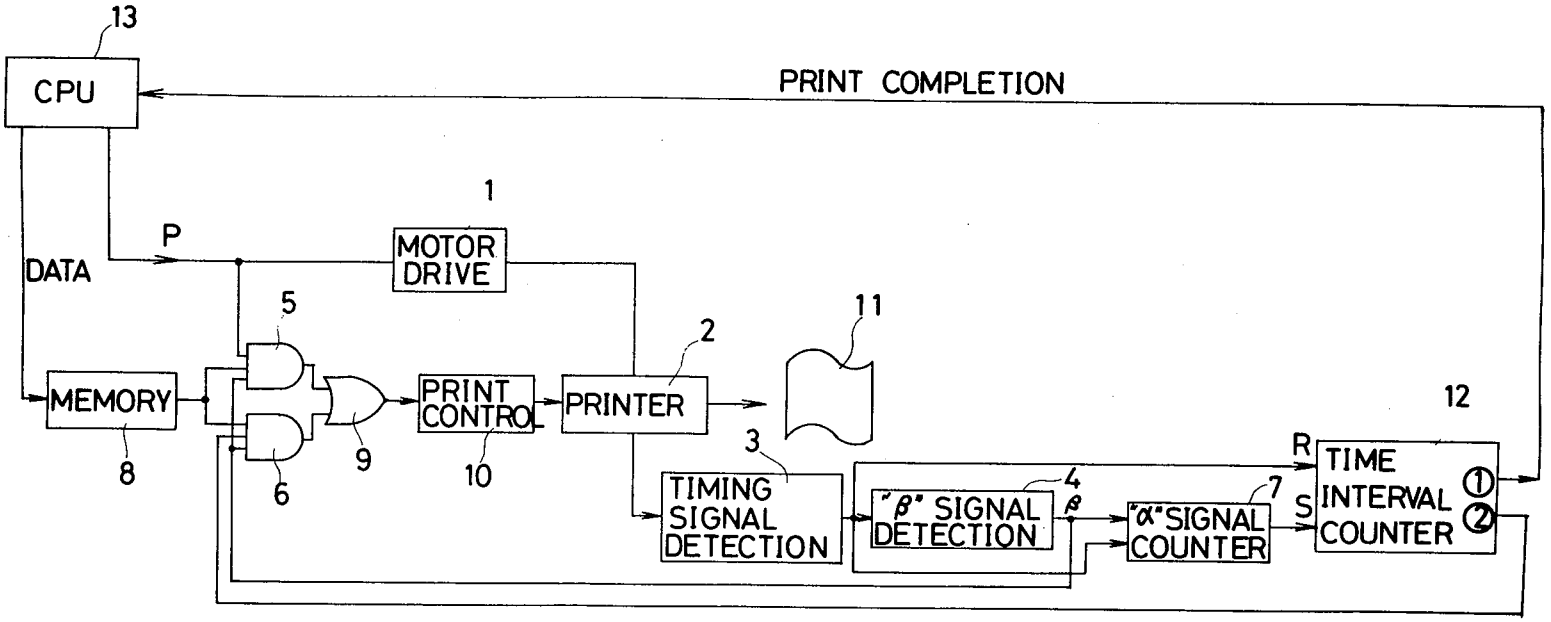
FIG. 7 is a block diagram of the embodiment of the print control system of the present invention.

FIG. 7 shows an embodiment of the print control system of the present invention.

The print control system of the present invention mainly comprises a timing signal detection circuit 3 for detecting timing signal ($\alpha$ and $\beta$) derived from a printer 2, a "$\beta$" signal detection circuit 4, an "$\alpha$" signal counter 7, and a time interval counter 12. When a print start command "P" is developed from a central processor unit 13, a motor drive circuit 1 activates a motor included in the printer 2. As already discussed above, the printer 2 develops the timing signals ($\alpha$ and $\beta$) in response to the rotation of the wheel shaft 22 (see FIGS. 1 and 2). The thus developed timing signals are applied to the timing signal detection circuit 3.

The "$\beta$" signal detection circuit 4 functions to measure the time interval "t" provided between two adjacent timing signals. More specifically, the "$\beta$" signal detection circuit 4 develops a detection output ("$\beta$" signal detection output) when $t \leqq T_\beta$. The thus abtained detection output derived from the "$\beta$" signal detection circuit 4 is applied to AND gates 5 and 6, and to the "$\alpha$" signal counter 7. When the "$\beta$" signal detection output is applied to the AND gate 5, print data applied from the central processor unit 13 and stored in a memory 8 is transferred to a print control circuit 10 through the AND gate 5 and an OR gate 9. Under these conditions, the electro-magnet mechanism 30 (see FIG. 1) is controlled in response to the type selection controlling signals ($\alpha$), whereby a desired printing is conducted by the printer 2 onto a print receiving paper 11.

On the other hand, the "$\alpha$" signal counter 7, which is set by the "$\beta$" signal detection output derived from the "$\beta$" signal detection circuit 4, functions to count up the timing signals derived from the timing signal detection circuit 3. When the "$\alpha$" signal counter 7 counts up the timing signals by the predetermined number "N," the "$\alpha$" signal counter 7 deverops an output signal for setting the time interval counter 12.

The time interval counter 12 functions to calculate the time interval t provided between the setting thereof and the occurrence of the next timing signal. If the time interval t satisfies the condition, $t \leqq T_\beta$, the time interval counter 12 develops a print completion signal through a first output terminal ① to indicate than an accurate printing has been conducted. The condition, $t \leqq T_\beta$, is satisfied only when the actual wheel round detection signal $\beta$ is developed, and applied to the reset input terminal of the time interval counter 12, next to the development of the N-th type selection controlling signal $\alpha_N$.

Contrarily, if the condition, $t \leqq T_\beta$, is not satisfied, the time interval counter 12 develops an error detection signal through a second output terminal ②. The thus developed error detection signal is applied to the AND gate 6. The system is placed in the waiting condition till the "$\beta$" signal detection circuit 4 detects the next arriving wheel round detection signal $\beta$. When the "$\beta$" signal detection output is developed from the "$\beta$" signal detection circuit 4 in response to the next wheel round detection signal $\beta$, the print data stored in the memory 8 is again applied to the print control circuit 10 via the AND gate 6 and the OR gate 9. In this way, the corrected printing is conducted by the printer 2.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A printer comprising:

at least one print wheel on which a plurality of types are mounted;

a wheel shaft for rotatably supporting said print wheel;

drive means for rotating said wheel shaft;

timing signal generation means for developing timing signals in response to rotation of said wheel shaft, said timing signals comprising:

type selection controlling signals having time interval corresponding to a space provided between two adjacent types mounted on said print wheel; and a wheel round detection signal for indicating a complete one round of said wheel shaft; and a print control system comprising:

first detection means for detecting occurrence of said wheel round detection signal to develop a first control signal;

first counter means for counting said type selection controlling signals, the count operation being initiated upon generation of said first control signal, and said first counter means developing a second control signal when said type selection controlling signals are counted by a predetermined number; and second detection means for determining whether said wheel round detection signal is developed next after development of said second control signal.

2. The printer of claim 1, said print control system further comprising:

memory means for storing print data to be printed out; and type selection means for selecting a desired type mounted on said print wheel in accordance with said print data stored in said memory means, said selecting operation being initiated upon generation of said first control signal from said first detection means.

3. The printer of claim 2, wherein said second detection means develops a first determination output when said wheel round detection signal is developed next after development of said second control signal, thereby indicating completion of the printing operation, and develops a second determination output when said wheel round detection signal is NOT developed next after development of said second control signal.

4. The printer of claim 3, said print control system further comprising:

corrected print conducting means for again activating said type selection means when said second determination output is developed from said second detection means.

5. The printer of claim 1, 2, 3 or 4, said second detection means comprising:

a time interval counter for calculating a time period provided between said second control signal and the occurrence of the timing signal next after the development of said second control signal; and judge means for determining whether the calculated time period is longer than a preselected time period.

6. The printer of claim 5, said timing signal generation means comprising:

a slit plate mounted on said wheel shaft; and an optical detection system for detecting slits formed in said slit plate.

7. The printer of claim 6, said slit plate comprising:

a plurality of slits formed in said slit plate, each slit being separated from each other by a distance corresponding to said space provided between two adjacent types mounted on said print wheel; and an additional slit for developing said wheel round detection signal.

* * * * *